US012789317B2

(12) United States Patent
Werth et al.

(10) Patent No.: US 12,789,317 B2
(45) Date of Patent: Nov. 10, 2026

(54) DOUBLE-SIDED OR SINGLE-SIDED MACHINE TOOL AND METHOD FOR OPERATING A DOUBLE-SIDED OR SINGLE-SIDED MACHINE TOOL

(71) Applicant: Lapmaster Wolters GmbH, Rendsburg (DE)

(72) Inventors: Sascha Werth, Rendsburg (DE); Robert Ravlic, Rendsburg (DE); Matthias Mantel, Rendsburg (DE); Kevin Rachor, Rendsburg (DE); Philipp Mielke, Rendsburg (DE)

(73) Assignee: Lapmaster Wolters GmbH, Rendsburg (DE)

( * ) Notice: Subject to any disclaimer, the term of this patent is extended or adjusted under 35 U.S.C. 154(b) by 580 days.

(21) Appl. No.: 18/316,065

(22) Filed: May 11, 2023

(65) Prior Publication Data

US 2023/0364738 A1 Nov. 16, 2023

(30) Foreign Application Priority Data

May 12, 2022 (DE) ..... 10 2022 111 923.8

(51) Int. Cl.
*B24B 49/00* (2012.01)
*B24B 37/04* (2012.01)

(52) U.S. Cl.
CPC ..... *B24B 49/00* (2013.01); *B24B 37/042* (2013.01)

(58) Field of Classification Search
CPC ..... B24B 37/00; B24B 37/042; B24B 37/08; B24B 37/10; B24B 37/015; B24B 37/005;
(Continued)

(56) References Cited

U.S. PATENT DOCUMENTS 7,001,243 B1 * 2/2006 Yi ..... B24B 37/013 451/41
2021/0291312 A1 * 9/2021 Nakamura ..... B24B 37/10
(Continued)

FOREIGN PATENT DOCUMENTS

CN 111461555 A 7/2020
DE 43 08 246 A1 9/1994
(Continued)

*Primary Examiner* — C. A. Rivera
(74) *Attorney, Agent, or Firm* — Young Basile Hanlon & MacFarlane, P.C.

(57) ABSTRACT

A double-sided or single-sided machine tool includes a first working disk and a counter-bearing element. The first working disk and the counter-bearing element can be driven rotationally relative to each other by means of a rotary drive. A working gap is formed between the first working disk and the counter-bearing element for the double-sided or single-sided machining of flat workpieces. The double-sided or single-sided machine tool comprises multiple sensors that record measurement data relating to tool and/or machining parameters of the double-sided or single-sided machine tool during operation. A control apparatus obtains the measurement data recorded by the sensors during operation. The control apparatus comprises an artificial neural network that is designed to create a state vector of the double-sided or single-sided machine tool from the measurement data and to compare said state vector with at least one target state vector.

20 Claims, 9 Drawing Sheets

(58) Field of Classification Search
CPC ..... B24B 49/00; B24B 49/02; B24B 49/14; B24B 49/16; B24B 49/105; B24B 49/12; B24B 7/228; B24B 7/17; B24B 51/00; H01L 21/304; B23Q 17/00
See application file for complete search history.

(56) References Cited

U.S. PATENT DOCUMENTS

| | | | | |
|---|---|---|---|---|
| 2022/0072679 | A1* | 3/2022 | Maruyama | B24B 37/12 |
| 2022/0097205 | A1 | 3/2022 | Boller et al. | |

FOREIGN PATENT DOCUMENTS

| | | | |
|---|---|---|---|
| DE | 10 2006 037 490 | B4 | 4/2011 |
| DE | 10 2016 102 223 | A1 | 8/2017 |
| DE | 10 2020 112 146 | A1 | 11/2021 |
| EP | 3974108 | A1 | 3/2022 |
| JP | 2020-109839 | A | 7/2020 |
| JP | 2021-150474 | A | 9/2021 |
| JP | 2022-055316 | A | 4/2022 |
| KR | 10-2022-0043039 | A | 4/2022 |
| WO | 2021/099159 | A1 | 5/2021 |

* cited by examiner

DOUBLE-SIDED OR SINGLE-SIDED MACHINE TOOL AND METHOD FOR OPERATING A DOUBLE-SIDED OR SINGLE-SIDED MACHINE TOOL

CROSS-REFERENCE TO RELATED APPLICATION(S)

This application claims priority to DE Patent Application No. 10 2022 111 923.8, filed May 12, 2022, the entire disclosure of which is hereby incorporated by reference.

TECHNICAL FIELD

This disclosure relates to a double-sided or single-sided machine tool and a method for operating such a tool, and more particularly to a tool comprising a preferably annular first working disk and a preferably annular counter-bearing element, wherein the first working disk and the counter-bearing element can be driven rotationally relative to each other by means of a rotary drive, and wherein a preferably annular working gap is formed between the first working disk and the counter-bearing element for the double-sided or single-sided machining of flat workpieces, preferably wafers, wherein the double-sided or single-sided machine tool comprises multiple sensors that record measurement data relating to tool and/or machining parameters of the double-sided or single-sided machine tool during operation of the double-sided or single-sided machine tool.

BACKGROUND

For example, in double-sided polishing machines, flat workpieces are polished between preferably annular working disks. A preferably annular working gap is arranged between the working disks, in which the flat workpieces, for example wafers, are held during machining. For this purpose, what are known as rotor disks are typically arranged in the working gap, with recesses in which the workpieces are mounted in a floating manner. For the machining, the working disks are driven rotationally relative to each other by means of a rotary drive and the rotor disks are also rotated in the working gap typically by external teeth of the rotor disks, which engage with corresponding teeth of pin rings. As a result, the workpieces are conveyed through the working gap along cycloidal paths during machining. In addition, a polishing agent, known as a slurry, is introduced into the working gap during double-sided polishing and ensures abrasive machining. In addition, in double-sided polishing machines, the working disks regularly have polishing cloths, known as polishing pads, on their surfaces delimiting the working gap.

The goal of the machining is a shape of the completely machined workpieces that is as plane-parallel as possible. The working gap geometry is of decisive importance for this. A double-sided machine tool with means for generating a global deformation of one of the working disks is known from DE 10 2006 037 490 B4. In particular, the upper working disk can be deformed between a globally concave and a globally convex shape. In the case of such a global deformation, the concave or convex shape of the working disk first results over the entire diameter of the working disk, viewed in the radial direction. The ring surface of the preferably annular working disk delimiting the working gap remains planar in itself; however, opposite ring portions of the ring surface are deformed in relation to each other so an overall concave or convex shape results.

A double-sided machine tool with means for generating a local deformation of one of the working disks, in particular between a local convex and a local concave shape, is also known from DE 10 2016 102 223 A1. In the case of such a local deformation, the convex or, respectively, concave shape results, in the radial direction, between the inner and outer edge of the (e.g., annular) working disk. Unlike with a global deformation, in the case of a local deformation the ring portions are thus themselves deformed concavely or convexly.

The two above embodiments can be combined in a double-sided machine tool. In this way, a wide range of working gap geometries can be generated. Thus, machining of the workpieces that is as plane-parallel as possible or, respectively, a setting of the working gap that is preferred for the workpiece quality, whether parallel or not, can be ensured at all times, for example, in the case of partial wear of the polishing cloths or in the case of changing temperatures of the components defining the working gap.

SUMMARY

The geometry of the working gap has a decisive influence on the shape and the evenness of the machined workpiece. In addition to the geometry of the working gap, the machining result is also influenced by a large number of additional tool and/or machining parameters, for example the temperature of a wide variety of components of the machine, the thickness and possible wear of a working lining, for example of a polishing cloth, the rotational speed of the working disk and/or counter-bearing elements rotated relative to each other, and of rotor disks that are rotatably mounted in the working gap, or for example a load between the first working disk and the counter-bearing element.

It is known to monitor tool and/or machining parameters of this kind during operation of the double-sided or single-sided machine tool by means of sensors. It is also known to use corresponding sensors to detect the shape and thickness of the flat workpieces, for example wafers, being machined in the working gap. A suitable parameter window must be found for operation of the double-sided or single-sided machine tool from the large number of said tool and machining parameters, initially as part of the setup of the double-sided or single-sided machine tool before commencement of the machining of the flat workpieces. The double-sided or single-sided machine tool must be adjusted to the conditions prevailing at the relevant location of use, for example the type of working linings, such as polishing cloths of a polishing agent, and other parameter specifications of an operator. During subsequent production operation of the double-sided or single-sided machine tool, the process must be monitored by means of the sensors. In the process, deviations from the specified target values, for example the Global Backside Ideal Range (GBIR) value or Side Frontside Least Square Range (SFQR) value of machined wafers, should be identified early and, if applicable, corrected during the machining process.

Not least because of a large number of different machining processes, the measurement results of the sensors must be interpreted by expert personnel in order to draw the right conclusions for adapting the production operation. Expert personnel of this kind are not available at every location at which a double-sided or single-sided machine tool is used. This can lead to negative effects on the production process. Furthermore, the production operation is often only adapted with a considerable time delay after the occurrence of any detrimental parameter deviations. One reason for this is that it is also difficult for expert personnel to identify a relevant deviation of the measured parameters early due to the large number of tool and machining parameters that have an influence on the production process. Frequently, this only occurs after finished, machined workpieces have been measured. If an undesired deviation is then discovered during the production process, a considerable number of rejects is produced in the meantime.

An object of this disclosure is to provide a double-sided or single-sided machine tool and a method for operating a double-sided or single-sided machine tool by means of which the production process of the double-sided or single-sided machine tool can be monitored more quickly and more reliably while minimizing rejects.

With regards to a double-sided or single-sided machine tool of the type mentioned at the outset, embodiments in accordance with the invention achieve the object in that a control apparatus is provided that obtains the measurement data recorded by the sensors during operation of the double-sided or single-sided machine tool, wherein the control apparatus comprises an artificial neural network that is designed to create a state vector of the double-sided or single-sided machine tool from the measurement data and to compare the state vector with at least one target state vector.

With regards to a method of the type mentioned at the outset, embodiments in accordance with the invention achieve the object in that the artificial neural network is trained by inputting a large number of target state vectors that lead to an acceptable machining result of flat workpieces.

The double-sided or single-sided machine tool in accordance with embodiments of the invention can be in particular a double-sided or single-sided polishing machine. However, the double-sided or single-sided machine tool can also be a double-sided or single-sided lapping machine or double-sided or single-sided grinding machine. The double-sided or single-sided machine tool has a preferably annular first working disk and a preferably annular counter-bearing element. In a single-sided machine tool, the counter-bearing element can be designed, for example, as a simple weight or pressure cylinder. The counter-bearing element can be a preferably annular second working disk. The first working disk and the counter-bearing element can be driven rotationally relative to each other, and a preferably annular working gap for machining flat workpieces, such as wafers, is formed between the first working disk and the counter-bearing element. Where the double-sided or single-sided machine tool is a double-sided or single-sided polishing machine, at least the first working disk, preferably also the counter-bearing element or, respectively, the second working disk, can have a polishing lining (polishing pad) on its surface(s) delimiting the working gap. During machining, a polishing medium, for example a polishing agent, in particular a polishing liquid (slurry), can be introduced into the working gap. The working disks can also be provided with tempering channels, through which a tempering liquid, for example, cooling water, is conducted to temper the working disk(s) during operation.

The double-sided or single-sided machine tool desirably serves for plane-parallel machining of flat workpieces. For the machining, the workpieces can be accommodated in a floating manner in recesses of rotor disks arranged in the working gap. The first working disk and the counter-bearing element are driven rotationally relative to each other, for example, by a corresponding drive shaft and at least one drive motor, during operation. It is possible that only one of the first working disk or the counter-bearing element is driven rotationally. However, both the first working disk and the counter-bearing element can also be driven rotationally, in this case typically in opposite directions. For example, in the case of a double-sided machine tool, the rotor disks can also be moved rotationally through the working gap by a suitable kinematic system during the relative rotation between the first working disk and the counter-bearing element. In this way, workpieces arranged in the recesses of the rotor disks describe cycloidal paths in the working gap. For example, the rotor disks can have teeth on their outer edges that engage with corresponding teeth of pin rings. Such machines form what is known as a planetary kinematic system.

The first working disk and/or the counter-bearing element can each be held by a support disk. Like the first working disk and the counter-bearing element, the support disks can also be annular or have at least annular support portions.

Sensors, in particular suitable measuring apparatuses, record measurement data relating to tool and/or machining parameters of the double-sided or single-sided machine tool during operation of the double-sided or single-sided machine tool. These may in particular be the tool and/or machining parameters mentioned at the outset. In particular, the sensors record the measurement data at defined intervals or continuously. The measurement data characterize the operating parameters and tool parameters of the double-sided or single-sided machine tool and thus the production process. The measurement data recorded by the sensors are in particular also supplied to a control apparatus of the double-sided or single-sided machine tool at defined intervals or continuously. The tool and/or machining parameters can be recorded in real time. This also applies for the forwarding of the measurement data to the control apparatus and for the processing of the measurement data described below.

The recorded measurement data can also be stored in a data memory and forwarded from there to the control apparatus, for example in real time or with a delay.

For the processing of the measurement data, a control apparatus in accordance with embodiments of the invention comprises an artificial neural network that creates a state vector of the double-sided or single-sided machine tool from the received measurement data. The state vector is composed of the current measurement data of the sensors or, respectively, is formed from the current measurement data. The state vector thus characterizes the double-sided or single-sided machine tool, and in particular the current production process. The artificial neural network compares this state vector with at least one, preferably, multiple target state vectors. The target state vectors are specified to the artificial neural network in accordance with a method in accordance with embodiments of the invention within the scope of training as state vectors for an acceptable machining result during machining of workpieces in the double-sided or single-sided machine tool. The target state vectors can be defined with different objectives, for example with a view to particular quality parameters (e.g., GBIR and/or SFQR) and/or production throughput or other parameters. By comparing the state vector created from the current measurement data with the target state vectors available to the artificial neural network, the artificial neural network can determine whether the current state vector matches one of the target state vectors trained as acceptable. If it is determined that the recorded state vector does not match any of the acceptable target state vectors, countermeasures can be implemented, for example, in the event of a relevant deviation from the acceptable target state vectors (e.g., the state vector deviates from the multiple target state vectors by greater than an acceptable deviation). For example, it is possible to intervene in the production process by adjusting tool and/or machining parameters. Of course, defined tolerances within which an identified minor deviation from the target state vectors is classified as acceptable can be specified for the comparison. By adjusting tool and/or machining parameters based on the comparison, the production process can be influenced in such a way that the currently created state vector (again) matches at least one target state vector to a sufficient degree.

Unlike an operator, an artificial neural network can create a state vector from a large quantity of measurement data and thus adjust tool and/or machining parameters very quickly and can compare the state vector with at least one and preferably a large number of target state vectors very quickly as well. As a result, an impermissible deviation of the production process from an acceptable process can be identified quickly and reliably, in particular also if there are not sufficiently trained or experienced personnel at the production location of the double-sided or single-sided machine tool. Embodiments in accordance with the invention make use of the fact that, in an optimal production process, the measurable tool and/or machining parameters have a fixed relationship to each other. An artificial neural network that is trained using the tool and/or machining parameters of an optimal process can thus quickly and reliably identify deviations of the current process from the optimal process. The artificial neural network constitutes an anomaly detector that identifies an impermissible deviation (anomaly) in the production process. Process optimization is thus possible much more quickly and with a much smaller number of test production processes, even in the case of the production process starting up after an initial setup process. In the best-case scenario, only one single production test is required, which requires no external downstream measurement of the machined workpieces. The production process can be monitored in a simpler and quicker manner while minimizing rejects, even during the beginning of production. In particular, the production of workpieces in the double-sided or single-sided machine tool that are outside desired tolerances can be reduced or, in the best-case scenario, can be completely prevented.

According to one embodiment, the control apparatus can be designed to issue a warning message in the event of a deviation of the created state vector from the at least one target state vector. The warning message can be issued to an operator of the double-sided or single-sided machine tool, for example via a user interface of the double-sided or single-sided machine tool. In the simplest case, the operator receives a warning message that tool and/or machining parameters deviate an impermissible extent from values that are acceptable for an optimal production process. On this basis, the operator can manually intervene in the process, in particular to adjust tool and/or machining parameters in a targeted manner. In this way, the state vector formed from the current measurement data (again) corresponds to at least one target state vector.

In another embodiment, the warning message may already include an adjustment suggestion for adjusting particular tool and/or machining parameters. This adjustment suggestion can be issued by means of the control apparatus on the basis of an adjustment rule stored in (e.g., memory of) the control apparatus. An adjustment rule of this kind may have been created beforehand by an operator of the double-sided or single-sided machine tool. The operator can then assess the adjustment suggestion and implement it if required. The control apparatus can thus automatically create suggestions for changing tool and/or machining parameters by means of a combination of determined deviations between the value of the state vector and the at least one target state vector with formalized causalities of the tool and/or machining parameters of the double-sided or single-sided machine tool.

According to another embodiment, the control apparatus may further comprise a regulation apparatus that is designed, in the event of a deviation of the created state vector from the at least one target state vector determined by means of the comparison, to control the double-sided or single-sided machine tool, in particular tool parameters and/or operating parameters of the double-sided or single-sided machine tool, such that the created state vector matches at least one target state vector. The regulation apparatus may in particular control actuators for influencing the tool and/or machining parameters. Additional automation is achieved by means of the regulation apparatus in that the regulation apparatus autonomously controls the double-sided or single-sided machine tool on the basis of the comparison that was performed. In this way, the state vector created from the current measurement data (again) corresponds to at least one of the target state vectors. The regulation apparatus may be integrated in the control apparatus.

The regulation apparatus may be designed to control the tool parameters and/or operating parameters (also referred to as machining parameters) of the double-sided or single-sided machine tool based on an adjustment rule stored in the regulation apparatus. In particular, the adjustment rule may specify, to the regulation apparatus, particular control rules relating to particular determined deviations of the state vector. In turn, the adjustment rule may, for example, have been created beforehand by an operator. On this basis, automated regulation based on control specifications stored beforehand in the form of the adjustment rule is possible, in particular without the intervention of an operator.

According to another embodiment, an additional artificial neural network may be provided that is designed to assess the measurement data relating to the tool and/or machining parameters by means of machine learning and to control the double-sided or single-sided machine tool, in particular tool and/or operating parameters of the double-sided or single-sided machine tool, based on the assessment and/or to create and/or modify an adjustment rule stored in a regulation apparatus. This additional artificial neural network may be a second artificial neural network in addition to the above-mentioned first artificial neural network that forms the anomaly detector. However, it is also conceivable for the functionality of the additional artificial neural network to be integrated with that of the above-mentioned artificial neural network that forms the anomaly detector. The regulation apparatus may also be integrated in the additional artificial neural network.

The additional artificial neural network may comprise a so-called learning classifier system (LCS), i.e., an artificial intelligence system. Systems of this kind are based on established if-then relationships and can modify tool and/or machining parameters of the double-sided or single-sided machine tool as a function of anomaly values, i.e., deviations between the current state vector and the at least one target state vector detected by means of the (first) artificial neural network. The LCS creates output data from input data and rules. The control apparatus may also comprise a memory in which tool and/or machining parameters obtained in the past, including data relating to workpieces to be machined, are stored. The stored data can be made available to the artificial neural network, in particular the LCS, which takes the data into account when assessing the measurement data and the resulting control data for the double-sided or single-sided machine tool. The artificial neural network preferably designed as an LCS can recognize the probability of the machining result of the workpieces, for example characteristic values such as GBIR and SFQR, deviating from specified target values as early as during a production process. On this basis, said artificial neural network can intervene as early as during the production process or at the latest in a subsequent production process by controlling, for example, actuators for particular tool and/or machining parameters in order to prevent rejects. The artificial neural network can also be used to improve an adjustment rule initially created, for example, an operator based on further experiences from production processes by means of machine learning. For this purpose, the artificial neural network may modify an adjustment rule stored in the regulation apparatus. It would also be conceivable for said adjustment rule to be created by means of the artificial neural network and then optimized if necessary or desirable based on additional process data. A maximum degree of automation of the production process without any intervention required from operators is possible by virtue of the above-mentioned embodiment.

According to another embodiment, the sensors may comprise measuring apparatuses for measuring the working gap, in particular the shape and/or width of the working gap, more particularly a distance between the first working disk and the counter-bearing element, and/or for measuring a temperature of the first working disk and/or of the counter-bearing element and/or of other machine components of the double-sided or single-sided machine tool and/or for measuring a temperature and/or a flow rate of machining agents supplied to the working gap for machining the workpieces, and/or for measuring a rotational speed of the first working disk and/or of the counter-bearing element and/or of rotor disks that are rotatably mounted in the working gap and/or for measuring a load between the first working disk and the counter-bearing element and/or for measuring a rotational speed and/or a torque and/or a temperature of the rotary drive and/or for measuring a pressure and/or a force of means for generating a deformation (i.e., a deformation generator) of the first working disk and/or the counter-bearing element and/or for measuring the thickness of a working lining of the first working disk and/or of the counter-bearing element and/or for measuring the thickness and/or shape of workpieces machined in the double-sided or single-sided machine tool. The above-mentioned measuring apparatuses may be present together or in any desired combinations. Machining agents may be, for example, polishing agents, in particular polishing liquids such as slurry. The above-mentioned measuring apparatuses record tool and machining parameters of the double-sided or single-sided machine tool that are relevant to the production process, including, for example, environmental data.

If the double-sided or single-sided machine tool, in particular tool and/or machining parameters of the double-sided or single-sided machine tool, are controlled on the basis of a deviation between the created state vector and the at least one target state vector determined by means of the comparison, this may in particular comprise controlling actuators for influencing the working gap, in particular the shape and/or width of the working gap, more particularly a distance between the first working disk and the counter-bearing element, and/or for influencing a temperature of the first working disk and/or of the counter-bearing element and/or of other machine components of the double-sided or single-sided machine tool and/or for influencing a temperature and/or a flow rate of machining agents supplied to the working gap for machining the workpieces, and/or for influencing a rotational speed of the first working disk and/or of the counter-bearing element and/or of rotor disks that are rotatably mounted in the working gap and/or for influencing a load between the first working disk and the counter-bearing element and/or for influencing a rotational speed and/or a torque and/or a temperature of the rotary drive and/or for measuring a pressure and/or a force of means for generating a deformation of the first working disk and/or the counter-bearing element and/or for influencing the thickness of a working lining of the first working disk and/or of the counter-bearing element and/or for influencing the thickness and/or shape of workpieces machined in the double-sided or single-sided machine tool. The above-mentioned instances of influencing or, respectively, controlling by the actuators may take place together or in any desired combinations. Machining agents may be, for example, polishing agents, in particular polishing liquids such as slurry. The actuators to be controlled therefore influence tool and machining parameters of the double-sided or single-sided machine tool that are relevant to the production process, including, for example, environmental data.

According to another embodiment, the counter-bearing element can be formed by a preferably annular second working disk, wherein the first and second working disks are arranged coaxially to each other and can be driven rotationally relative to each other. The working gap is formed between the working disks for double-sided or single-sided machining of flat workpieces.

This disclosure also relates to a system comprising at least two double-sided or single-sided machine tools in accordance with embodiments of the invention, wherein a higher-level artificial neural network is provided that is connected to the artificial neural networks of the at least two double-sided or single-sided machine tools. The higher-level artificial neural network is designed to train at least one artificial neural network of the at least two double-sided or single-sided machine tools based on data obtained by the artificial neural networks of the at least two double-sided or single-sided machine tools by inputting state vectors that lead to an acceptable machining result of the workpieces.

In this embodiment, a system consisting of at least two, and preferably more than two, double-sided or single-sided machine tools in accordance with embodiments of the invention is provided. Furthermore, a higher-level artificial neural network is provided that is connected to the artificial neural networks of the at least two double-sided or single-sided machine tools. The higher-level artificial neural network is designed to train an artificial neural network of the at least two double-sided or single-sided machine tools based on the data obtained by the artificial neural networks of the at least two double-sided or single-sided machine tools. The higher-level neural network thus forms a higher-level structure into which similar double-sided or single-sided machine tools can be integrated. Furthermore, a cross-plant memory may then be provided that obtains data of similar double-sided or single-sided machine tools of the system and that also provides said data to the higher-level artificial neural network. In this way, the individual double-sided or single-sided machine tools of the system can be optimized, if applicable in consideration of the data stored in the memory, with mutual use of individual data of the double-sided or single-sided machine tools of the system. In these embodiments, advantageous effects can be achieved, for example with regards to production planning, fleet management, or predictive maintenance.

A double-sided or single-sided machine tool according to embodiments of the invention can be designed to carry out a method according to embodiments of the invention. Accordingly, a method according to embodiments of the invention can be implemented using a double-sided or single-sided machine tool according to embodiments of the invention.

As already explained, in a method according to embodiments of the invention, the artificial neural network is trained by inputting a large number of state vectors that lead to an acceptable machining result of flat workpieces. The training can take place in that production processes with the double-sided or single-sided machine tool are carried out by an operator using different tool and/or machining parameters and, depending on the machining result, it is specified to the artificial neural network with regards to the respective tool and/or machining parameters whether the production process has led to an acceptable machining result. In this case, the associated tool and/or machining parameters are stored in the artificial neural network as a target state vector. This start-up training generally takes place before the start of regular machining of flat workpieces with the double-sided or single-sided machine tool.

Furthermore, it is possible for the artificial neural network trained in this manner to be trained further during operation of the double-sided or single-sided machine tool by inputting additional target state vectors that lead to an acceptable machining result of flat workpieces. Due to this additional training during production processes with the double-sided or single-sided machine tool, the tool and/or machining parameters are optimized further.

According to another embodiment, an additional artificial neural network can be trained using the trained artificial neural network by inputting a large number of target state vectors that lead to an acceptable machining result of flat workpieces during operation of the double-sided or single-sided machine tool. Said additional artificial neural network may be untrained or already (pre)trained. For example, the additional artificial neural network may be a copy of the trained artificial neural network and be trained further on this basis. This may be useful, for example, if the trained artificial neural network is a generic neural network that is trained for a particular type of double-sided or single-sided machine tool, but that has not yet been specialized for a specialized double-sided or single-sided machine tool, in particular with respect to the respective individual machining parameters on site. As a result, a specialized version of the trained artificial neural network can be generated that can eventually replace the trained artificial neural network. One possible application scenario is that double-sided or single-sided machine tools can be delivered with a trained artificial neural network, wherein the training takes place based on of tests or, respectively, laboratory data of a manufacturer of the double-sided or single-sided machine tool. Then, further specialization for the individual manufacturing process of the client takes place using the additional recent neural network. This requires less understanding of the production process at the installation site of the double-sided or single-sided machine tool.

BRIEF DESCRIPTION OF THE DRAWINGS

Exemplary embodiments of the invention are explained below in greater detail using schematic drawings.

The same reference numbers refer to the same objects in the figures unless indicated otherwise.

DETAILED DESCRIPTION

Figure 1:
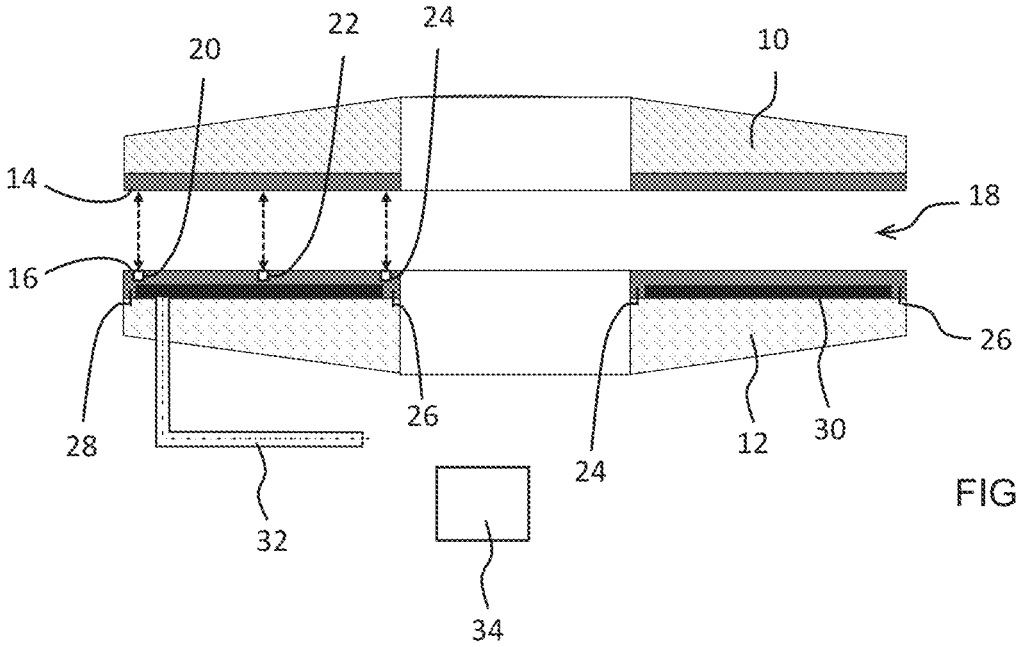
FIG. 1 shows part of a double-sided or single-sided machine tool according to embodiments of the invention in a sectional view in a first operating state.
Figure 2:
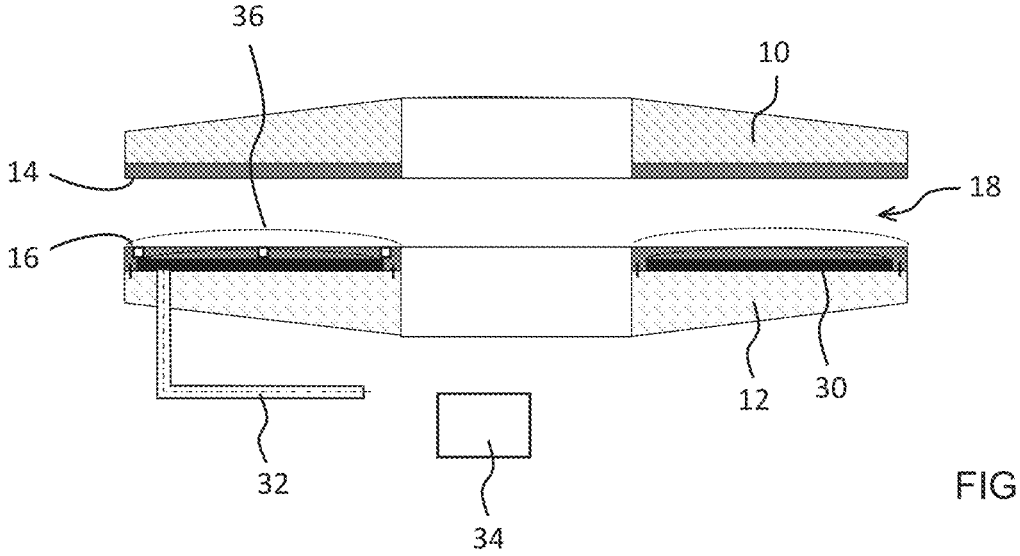
FIG. 2 shows the view from FIG. 1 in a second operating state.
Figure 3:
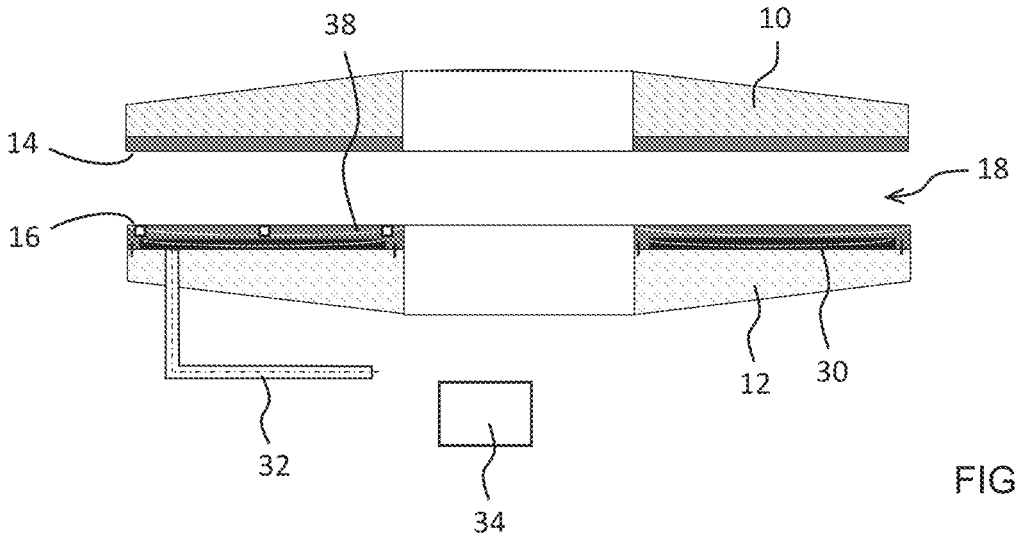
FIG. 3 shows the view from FIG. 1 in a third operating state.

The double-sided (e.g., or single-sided) machine tool depicted merely as an example in FIGS. 1 to 3 has an annular upper support disk 10 and also an annular lower support disk 12 (e.g., a first working disk and a second working disk are arranged coaxially to each other). A first annular upper working disk 14 is fastened to the upper support disk 10 and a second, likewise annular lower working disk 16 as a counter-bearing element is fastened to the lower support disk 12. Between the annular upper working disk 14 and the annular lower working disk 16, an annular working gap 18 is formed in which flat workpieces such as wafers are machined on both sides during operation (e.g., the artificial neural network of each of the at least two double-sided or single-sided machine tools by inputting state vectors that lead to an acceptable machining result of flat workpieces). The double-sided (e.g., or single-sided) machine tool can be a polishing machine, lapping machine, or a grinding machine, for example.

The upper support disk 10 and with it the upper working disk 14 and/or the lower support disk 12 and with it the lower working disk 16 can be driven rotationally (e.g., at a rotational speed) relative to each other by a suitable drive apparatus, comprising, for example, an upper drive shaft and/or a lower drive shaft and at least one drive motor (e.g., a rotary drive). The drive apparatus is known per se and will not be described further for reasons of clarity. In a manner that is also known per se, the workpieces to be machined can be held (e.g. mounted) in the working gap 18 in a floating manner in rotor disks. Using suitable kinematics, for example planetary kinematics, it can be ensured that the rotor disks also rotate through the working gap 18 during the relative rotation of the upper support disk 10 and the lower support disk 12 or, respectively, the upper working disk 14 and the lower working disk 16. In the upper working disk 14 or the upper support disk 10 and possibly also the lower working disk 16 or the lower support disk 12, temperature-control channels can be designed through which a temperature-control fluid, for example, a temperature-control liquid such as cooling water, can be conveyed during operation. This is also known per se and is not shown in more detail. At least one of a temperature or a flow rate of a machining agent supplied to the working gap for machining the flat workpieces.

The double-sided machine tool shown in FIGS. 1 to 3 further comprises distance-measuring apparatuses that are also known per se as sensors. The sensors may, for example, operate optically or electromagnetically (e.g., eddy current sensors). In the example shown, a first distance-measuring apparatus 20, a second distance-measuring apparatus 22, and a third distance-measuring apparatus 24 are provided, for example, which measure the distance between the upper working disk 14 and the lower working disk 16 at three radially spaced positions of the working gap 18, as illustrated by arrows in FIG. 1. The sensors may comprise measuring apparatuses for measuring the working gap, in particular the shape and/or width of the working gap, more particularly a distance between the first working disk and the counter-bearing element, and/or for measuring a temperature of the first working disk and/or of the counter-bearing element and/or of other machine components of the double-sided or single-sided machine tool and/or for measuring a temperature and/or a flow rate of machining agents supplied to the working gap for machining the workpieces, and/or for measuring a rotational speed of the first working disk and/or of the counter-bearing element and/or of rotor disks that are rotatably mounted in the working gap and/or for measuring a load between the first working disk and the counter-bearing element and/or for measuring a rotational speed and/or a torque and/or a temperature of the rotary drive and/or for measuring a pressure and/or a force of means for generating a deformation (i.e., a deformation generator) of the first working disk and/or the counter-bearing element and/or for measuring the thickness of a working lining of the first working disk and/or of the counter-bearing element and/or for measuring the thickness and/or shape of workpieces machined in the double-sided or single-sided machine tool. As can be seen, the first distance-measuring apparatus 20 measures the distance between the upper working disk 14 and the lower working disk 16 in the region of the radially outer edge of the working gap 18. The third distance-measuring apparatus 24 measures the distance between the upper working disk 14 and the lower working disk 16 in the region of the radially inner edge of the working gap 18. The second distance-measuring apparatus 22 measures the distance between the upper working disk 14 and the lower working disk 16 in the center of the working gap 18.

The first distance-measuring apparatus 20, the second distance-measuring apparatus 22, and the third distance-measuring apparatus 24 have not been shown in FIGS. 2 and 3 for reasons of clarity. The measurement data of the first distance-measuring apparatus 20, the second distance-measuring apparatus 22, and the third distance-measuring apparatus 24 are supplied or provided to the control apparatus 34.

A control apparatus, such as the control apparatus 34, can be or include a microprocessor, processor, or other computing component with input and output connections coupled to the components described herein. A control apparatus is configured to perform the methods described herein. For example, a control apparatus can be programmed to perform the methods described herein. A control apparatus can include computer-readable instructions stored in a non-transitory storage medium that, when executed, causes the control apparatus to perform the methods described herein. A control apparatus can contain both hardware and software to implement the various functions described herein. For example, any of the artificial neural networks of a control apparatus described herein can be implemented by hardware, software, or some combination thereof.

In the present case, the lower working disk 16 is fastened to the lower support disk 12 only in the regions of the outer edge and the inner edge of the second working disk 16, for example, screwed along a partial circle in each case, as illustrated in FIG. 1 as a first fastening location 26 and a second fastening location 28. In contrast, the lower working disk 16 is not fastened to the lower support disk 12 between the first fastening location 26 and the second fastening location 28. Instead, between the first fastening location 26 and the second fastening location 28, an annular pressure volume 30 is located between the lower support disk 12 and the lower working disk 16. The pressure volume 30 is connected to a pressure fluid reservoir, for example a liquid reservoir, in particular a water reservoir, via a dynamic pressure line 32. In the dynamic pressure line 32, a pump and a control valve can be arranged. The pump and/or the control valve can be controlled by the control apparatus 34. In this way, a desired pressure that acts on the lower working disk 16 can be built up in the pressure volume 30 by fluid introduced into the pressure volume 30. The pressure prevailing in the pressure volume 30 can be measured by a pressure measuring apparatus. The measurement data of the pressure measuring apparatus can also be provided to the control apparatus 34 so that the control apparatus 34 can set a specified pressure in the pressure volume 30.

Due to its freedom of movement between the first fastening location 26 and the second fastening location 28, the lower working disk 16 can be brought into a convex shape locally, as indicated in FIG. 2 by a dotted line depicting a convex deformation 36, by setting a sufficiently high pressure in the pressure volume 30. If a pressure $p_0$ is assumed in the pressure volume 30 in the operating state of FIG. 1, in which the lower working disk 16 has a planar shape, the convex deformation 36 of the lower working disk 16 shown in FIG. 2 can be achieved by setting a pressure $p_1>p_0$. On the other hand, a local concave deformation of the lower working disk 16 can be achieved by setting a pressure $p_2<p_0$ in the pressure volume 30, as illustrated in FIG. 3 by a dotted line depicting a concave deformation 38.

In this case, it can be seen that the lower working disk 16 can take on a locally convex shape (FIG. 2) or, respectively, a locally concave shape (FIG. 3), viewed in the radial direction, between its inner edge, in the region of the first fastening location 26, and its outer edge, in the region of the second fastening location 28.

In addition to this local radial deformation of the lower working disk 16, means can be provided for global deformation of the upper working disk 14. These means may be designed as described above or, respectively, in DE 10 2006 037 490 B4. The upper support disk 10 and with it the upper working disk 14 fastened thereto is globally deformed, such that a globally concave or globally convex shape of the working surface of the upper working disk 14 is produced over the entire cross section of the upper working disk 14. In contrast, the upper working disk 14, between its radially inner edge and its radially outer edge, may remain planar or be locally deformed in the above-mentioned manner by means of the pressure volume 30. The means for adjusting the shape of the upper working disk 14 can also be controlled by the control apparatus 34.

The first distance-measuring apparatus 20, the second distance-measuring apparatus 22, and the third distance-measuring apparatus 24 form sensors that record measurement data relating to tool and/or machining parameters of the double-sided machine tool, in the present case the thickness and geometry of the working gap 18, in particular during operation of the double-sided machine tool. Preferably, the double-sided machine tool comprises multiple additional sensors having corresponding additional measuring apparatuses. Said measuring apparatuses may be measuring apparatuses of the type explained above. Said measuring apparatuses record additional tool and/or machining parameters during operation of the double-sided machine tool.

The measurement data recorded by the sensors are fed to the control apparatus 34. The sensors may measure at least one of a pressure or a force of a deformation generator of at least one of the first working disk or the counter-bearing element. The sensors may assist in controlling a shape and/or a width of the working gap between the first working disk and the counter-bearing element. The first working disk and second working disk are arranged coaxially to each other. From said measurement data, the control apparatus 34 creates a state vector of the double-sided machine tool by means of an artificial neural network (e.g., that may be pretrained prior to operation) integrated in the control apparatus 34 and compares said state vector with at least one target state vector, preferably a set of target state vectors that were assigned to an acceptable production process within the scope of training. The regulator is designed, when the state vector created deviates from the target state vector, to control at least one of the tool parameters of the operating parameters such that the state vector resulting from the control matches the target state vector. The method may include inputting state vectors that lead to an acceptable machining result of flat working pieces Stated generally, the state vector is a mathematical vector with a number of possible parameters. As described in further detail below, each parameter can be a measured value. For example, a current pad temperature, working disk distance, force or pressure between working disks and/or constructional fixed values, such as number of workpieces, position of workpieces in carrier disk, type of polishing pad, essentially everything that is unchangeable in the process, and/or target values for a number of controls, such as pressure/force, rotation of working disks per minute, disk temperature, etc.

Figure 4:
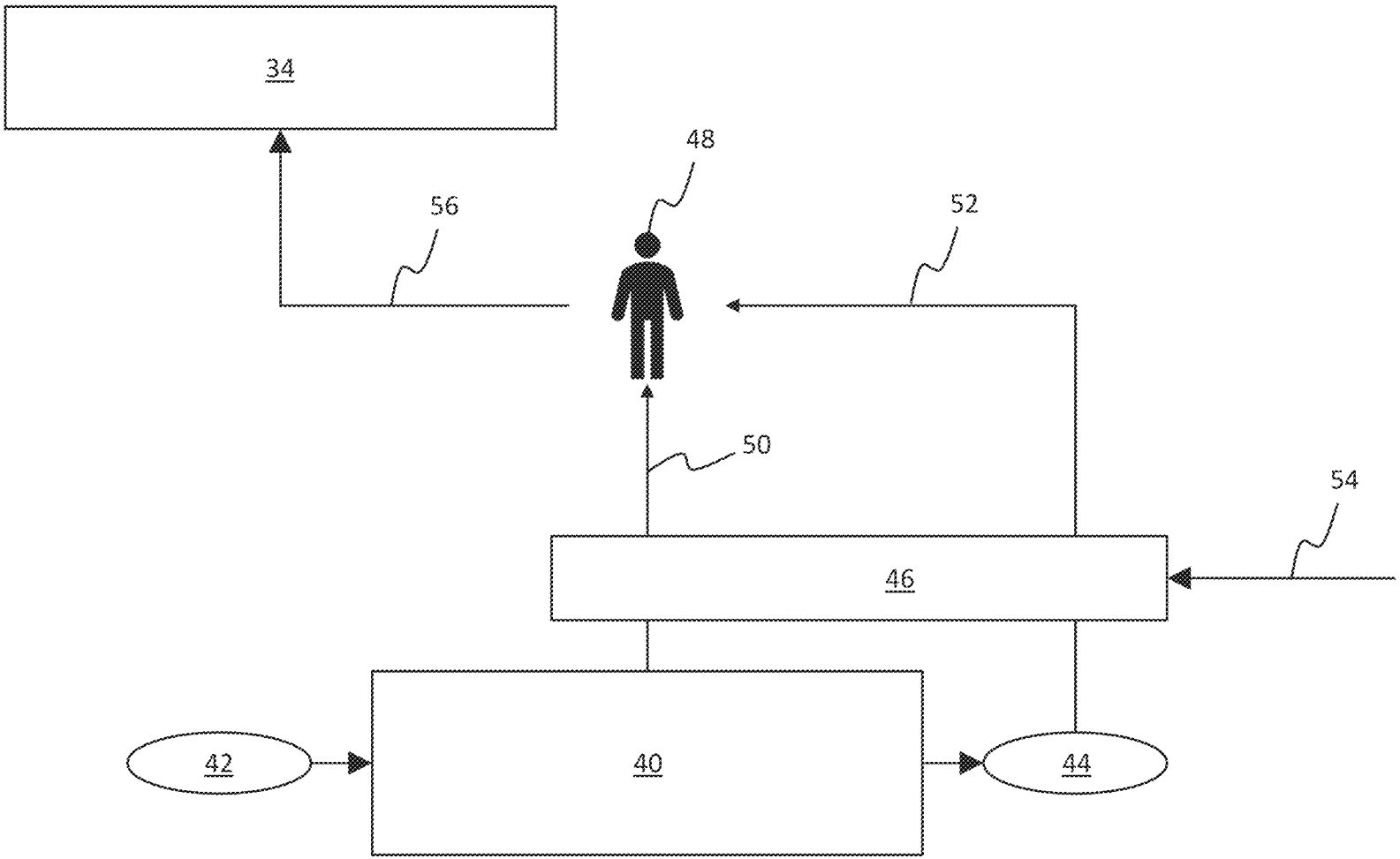
FIG. 4 is a schematic representation of the function of the double-sided machine tool in accordance with a first embodiment of the invention.

Training of the artificial neural network integrated in the control apparatus 34 will be explained in more detail based on FIG. 4. A double-sided machine tool 40 in accordance with an embodiment of the invention is shown in FIG. 4. Unmachined workpieces 42, for example unmachined wafers, are supplied to the double-sided machine tool 40 for machining and finished machined workpieces 44, in particular machined wafers, are output by means of the double-sided machine tool 40. A data memory 46 is provided, to which, for example, measurement data relating to tool and machining parameters recorded by the sensors are supplied. Said data are made available to an operator 48, as illustrated in FIG. 4 with arrow 50. Furthermore, measurement data relating, for example, to the geometry of the machined workpieces are fed to the data memory 46 as additional tool and/or operating parameters, wherein said data are also fed to the operator 48, as illustrated in FIG. 4 with arrow 52. Finally, external environmental data are also available to the data memory, as illustrated with arrow 54. Said external environmental data may also be fed to the operator 48. On this basis, the operator 48 performs an assessment of the production process underlying the respective data as to whether the machining result is acceptable. The operator 48 makes this assessment available to the artificial neural network of the control apparatus 34, as shown in FIG. 4 with arrow 56. The corresponding state vectors are stored as target state vectors by the artificial neural network.

Figure 5:
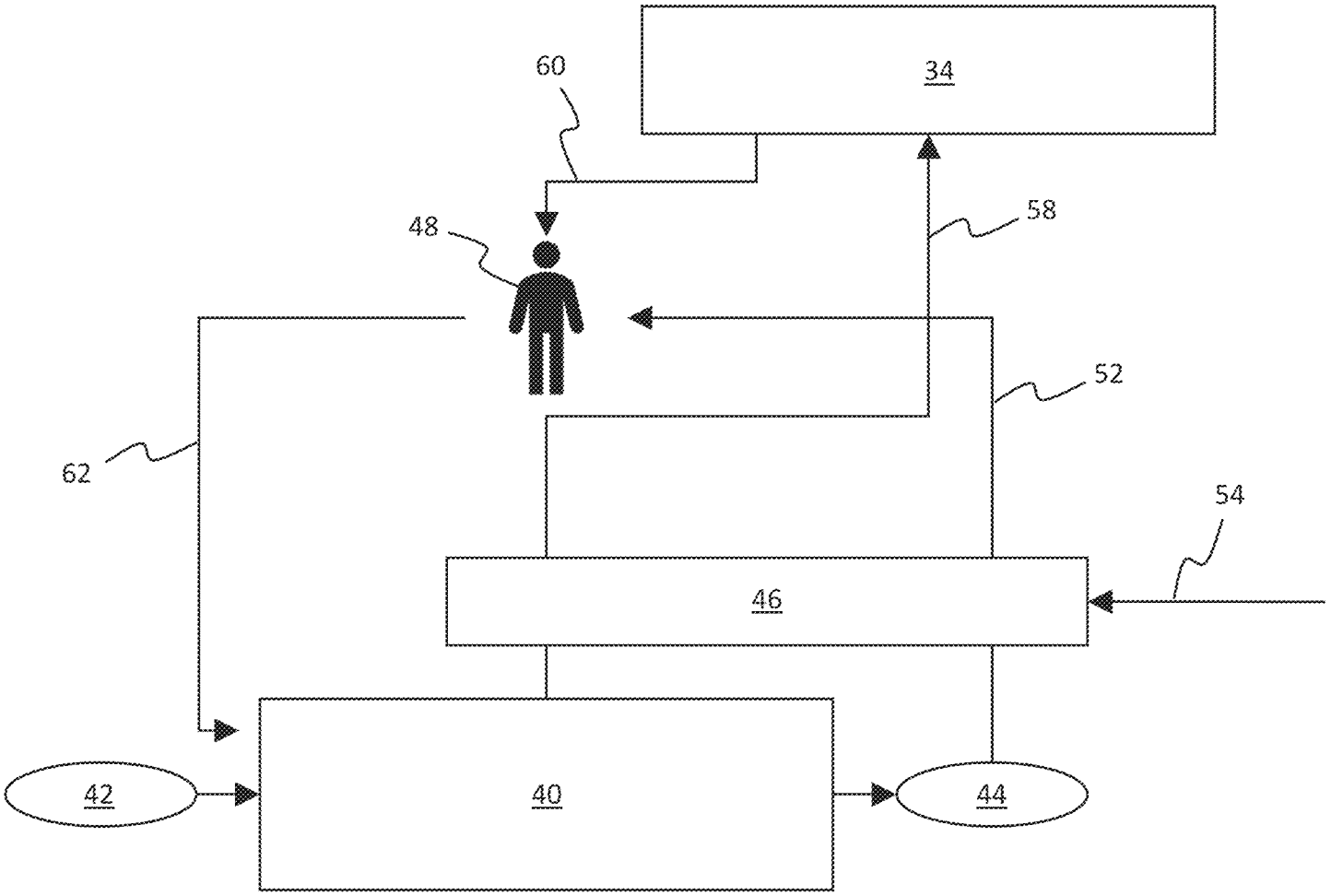
FIG. 5 is a schematic representation of the function of the double-sided machine tool in accordance with a second embodiment of the invention.

FIG. 5 shows how the double-sided machine tool can be operated on this basis. In this case, the process data relating to the tool and/or machining parameters can be supplied directly to the artificial neural network of the control apparatus 34, as illustrated in FIG. 5 with arrow 58. The artificial neural network creates a state vector from the obtained measurement data relating to the tool and/or machining parameters and compares said state vector with the stored target state vectors (e.g., the state vector resulting from the control matches the target state vector). If an impermissible deviation or, respectively, discrepancy is found, the control apparatus 34 issues a corresponding warning message to the operator 48, as shown in FIG. 5 with arrow 60. On this basis and, if applicable, in consideration of the measurement data of the machined workpieces 44 made available (shown via arrow 52), the operator 48 can control the double-sided machine tool 40, in particular the actuators for influencing tool and/or operating parameters, as shown in FIG. 5 with arrow 62, in order to bring the continuously monitored and created state vector in line with at least one target state vector. In this case, the operator 48 thus decides on the consequences from the assessment of the received data. The operator 48 is supported in this by the control apparatus 34 as an anomaly detector.

Figure 6:
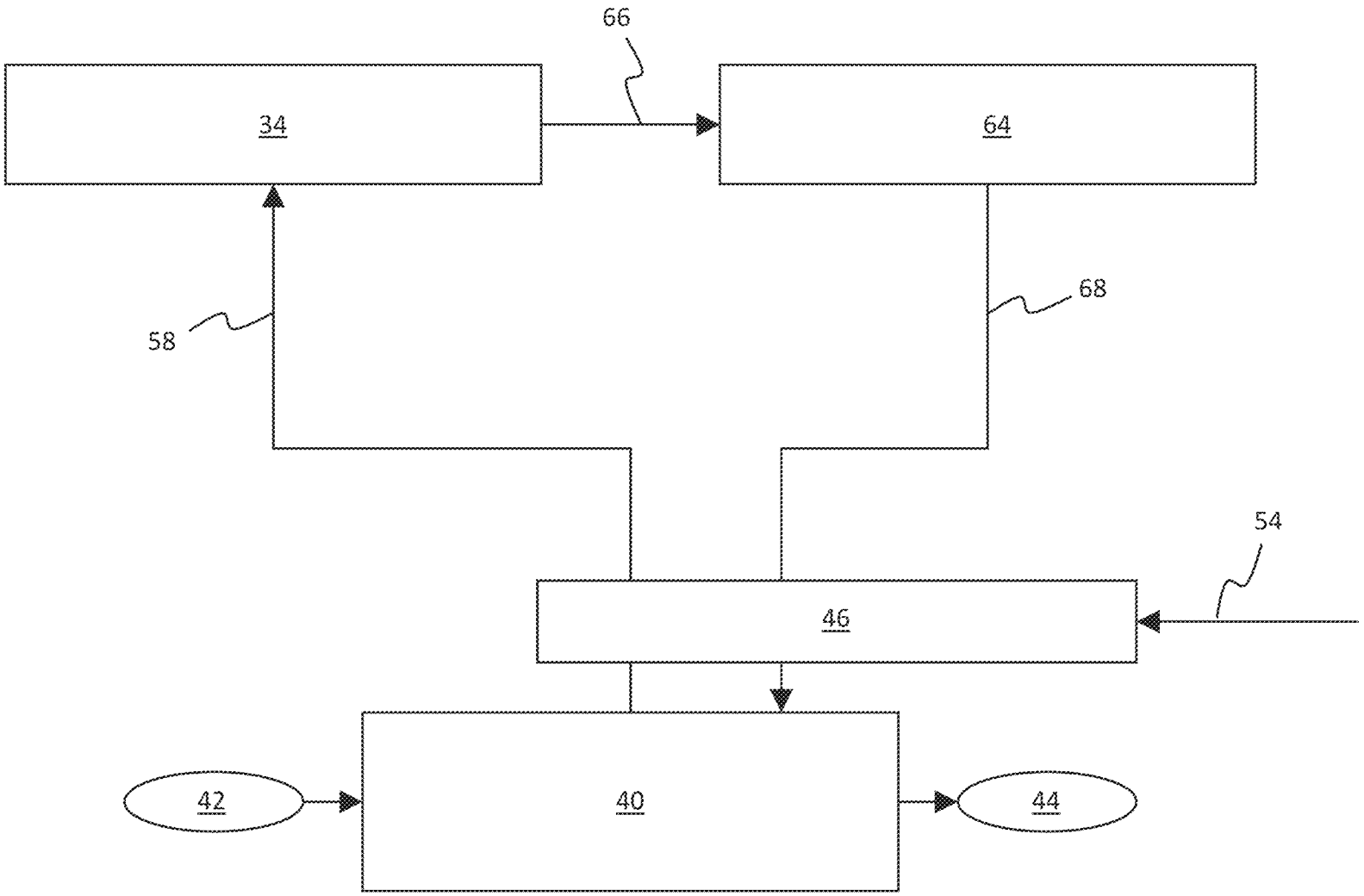
FIG. 6 is a schematic representation of the function of the double-sided machine tool in accordance with a third embodiment of the invention.

FIG. 6 shows another automated variant of the procedure shown in FIG. 5. In this embodiment, the control apparatus 34, in particular its artificial neural network, further comprises a regulation apparatus 64 connected thereto, as shown in FIG. 6 with arrow 66. In the event of a deviation between the created state vector and the at least one target state vector that is found by means of the comparison, regulation intervention by the regulation apparatus 64 in actuators of the double-sided machine tool 40 takes place without the intervention of the operator 48 (e.g., the state vector resulting from the control matches one of the multiple target state vectors). This results in an adjustment of the recorded tool and/or machining parameters of the double-sided machine tool 40, as illustrated in FIG. 6 with arrow 68. All of the associated data can be stored in the data memory 46. The control apparatus 34 and the regulation apparatus 64, which are, for example, designed to be integral, can control the tool and/or operating parameters of the double-sided machine tool 40 based on an adjustment rule stored, for example, in the regulation apparatus 64. This adjustment rule may, for example, contain particular control instructions for particular established deviations of the tool and/or machining parameters created by an operator 48, according to which rule the control apparatus 34 and the regulation apparatus 64 control actuators.

Figure 7:
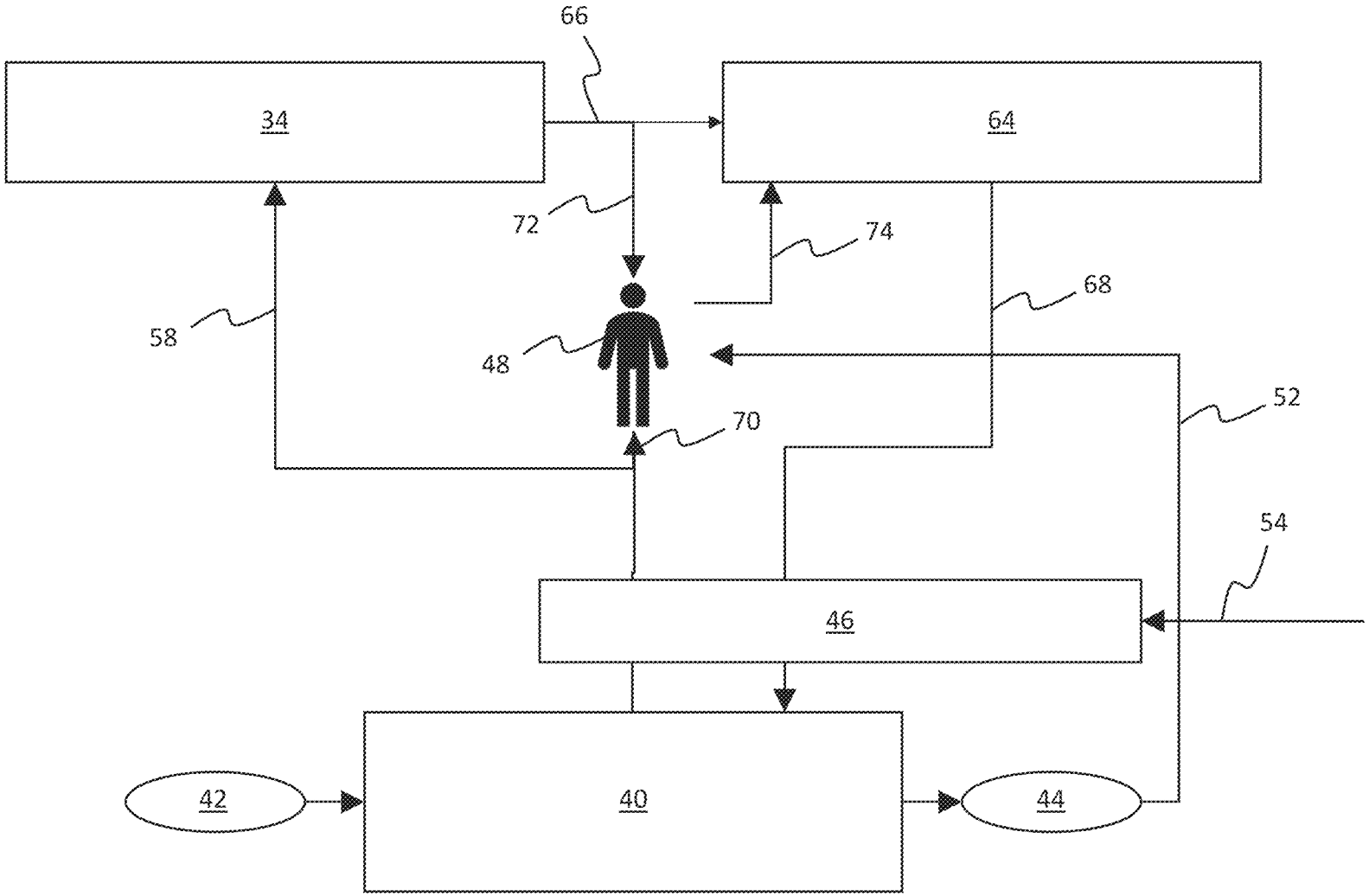
FIG. 7 is a schematic representation of the function of the double-sided machine tool in accordance with a fourth embodiment of the invention.

FIG. 7 shows another embodiment of the procedure explained with reference to FIG. 6. The operator 48 is also involved in this embodiment. The operator 48 also obtains the process data relating to the recorded tool and machining parameters, as shown in FIG. 7 with arrow 70, and obtains the process data relating to the machined workpieces, as shown with arrow 52. Finally, the operator 48 also obtains the control commands performed by the control apparatus 34, as shown in FIG. 7 with arrow 72. On this basis, the respectively performed regulation can be monitored by the operator 48 and, if applicable, the regulation of the regulation apparatus 64 can be adjusted in a suitable manner, as shown in FIG. 7 with arrow 74.

Figure 8:
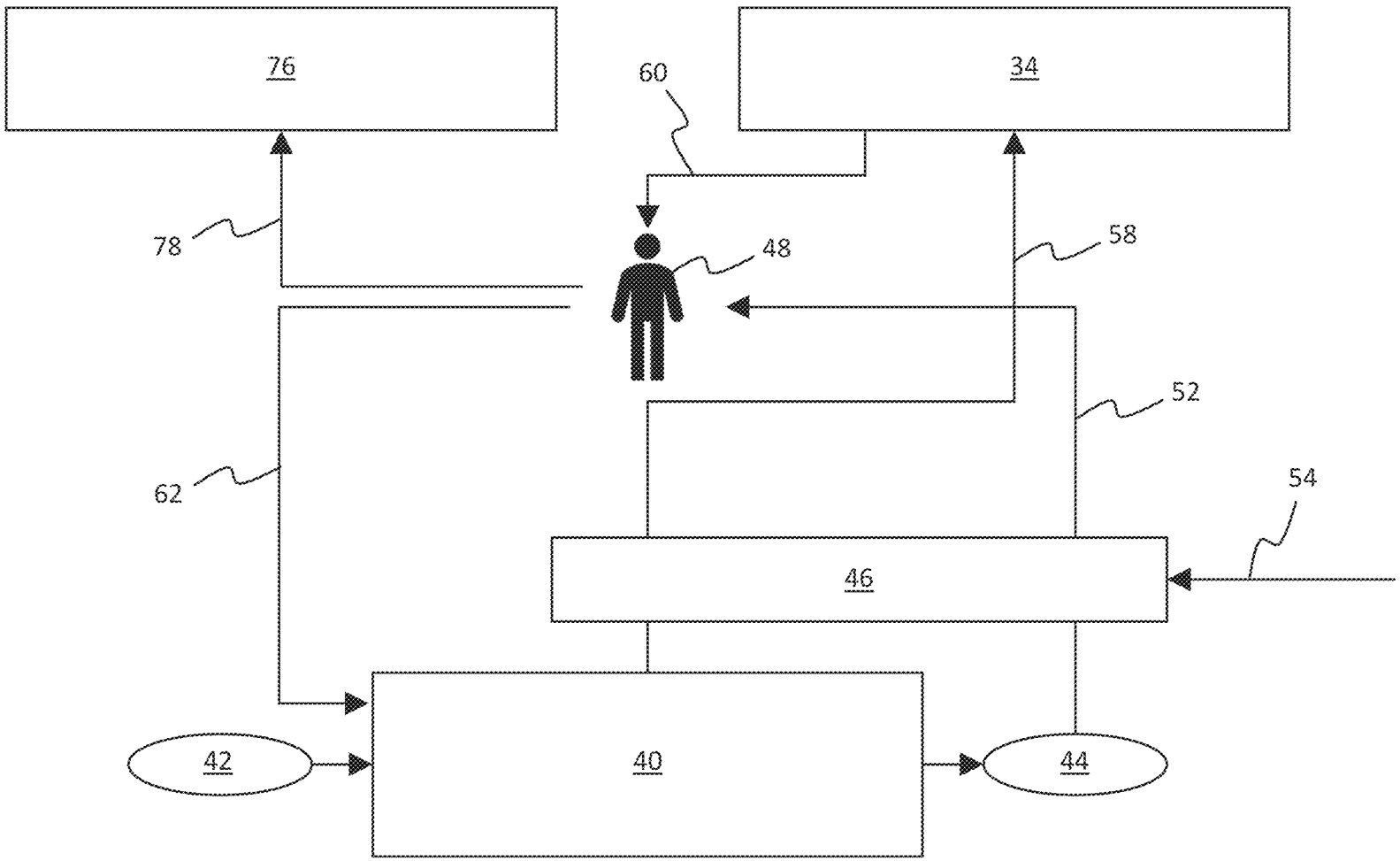
FIG. 8 is a schematic representation of the function of the double-sided machine tool in accordance with a fifth embodiment of the invention.

FIG. 8 presents another embodiment of possible training of artificial neural networks as anomaly detectors. Here, training is done proceeding from the control apparatus 34 with an already pretrained artificial neural network, for example as explained above with reference to FIG. 4. Said control apparatus 34 issues any deviations or, respectively, anomaly data to the operator 48, as shown in FIG. 8 with arrow 60 and explained above with reference to FIG. 5. On this basis, the operator 48 can train an additional artificial neural network 76 in that said additional artificial neural network 76 is fed (further) target state vectors to acceptable tool and/or machining parameters of the double-sided machine tool 40 during operation of the double-sided machine tool 40, as shown in FIG. 8 with arrow 78. The additional artificial neural network 76 may be an untrained additional artificial neural network 76. However, it may also be an already (pre) trained additional artificial neural network 76, for example a duplicate of the neural network of the control apparatus 34. On this basis, specialized training of the additional artificial neural network 76 can be trained at the start of a production operation for the respective individual process parameters of the application scenario of the double-sided machine tool 40 based on the artificial neural network of the control apparatus 34 (pre) trained, for example, for the generic type of double-sided machine tool 40. The additional artificial neural network may be provided that is designed to assess the measurement data relating to the tool and/or machining parameters by means of machine learning and to control the double-sided or single-sided machine tool, in particular tool and/or operating parameters of the double-sided or single-sided machine tool. based on the assessment and/or to create and/or modify an adjustment rule stored in a regulation apparatus (e.g. a regulator). After said training, it is possible for the additional artificial neural network 76 to replace the previously trained artificial neural network of the control apparatus 34.

Figure 9:
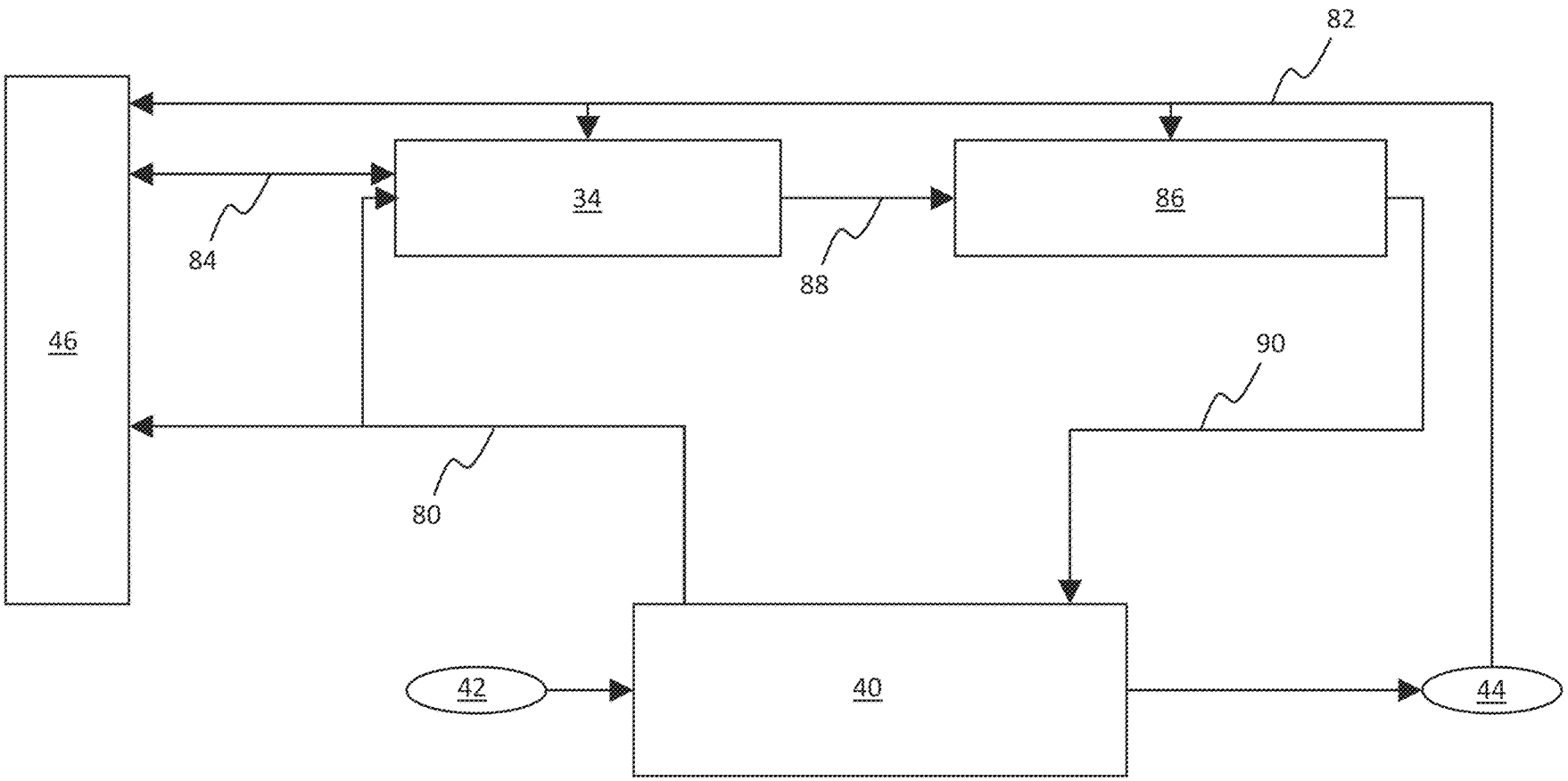
FIG. 9 is a schematic representation of the function of the double-sided machine tool in accordance with a sixth embodiment of the invention.

Another embodiment of the invention will be explained based on FIGS. 9 and 10. This embodiment includes an additional artificial neural network 86 that is designed for machine learning. It may be a LCS, i.e., an artificial intelligence system. In the embodiment shown in FIG. 9, measurement data of the sensors relating to tool and/or machining parameters are supplied to the data memory 46, on the one hand, and to the control apparatus 34, on the other hand, as shown in FIG. 9 with arrow 80. Workpiece data, in particular measurement data relating to the geometry of the machined workpieces 44, are also supplied to both the data memory 46 and the control apparatus 34, as shown in FIG. 9 with arrow 82. The control apparatus 34 is also in exchange with the data memory 46, as shown in FIG. 9 with arrow 84. In FIG. 9, an additional artificial neural network 86 is shown, which is associated with the control apparatus 34. Said additional artificial neural network 86 may also be combined with the artificial neural network of the control apparatus 34. Said additional artificial neural network 86 is designed for machine learning and in particular forms a LCS.

The measurement data relating to the geometry of the machined workpieces 44 are also fed to the additional artificial neural network 86 (shown via arrow 82). If an inadmissible deviation between the currently recorded state vector and the acceptable values of the tool and/or machining parameters stored as target state vectors is found by the control apparatus 34, in particular its artificial neural network, during operation of the double-sided machine tool 40, a corresponding anomaly signal is output to the additional artificial neural network 86, as shown in FIG. 9 with arrow 88. Measurement data from the past can also be available to the additional artificial neural network 86 from the data memory 46. On this basis, the additional artificial neural network 86 can autonomously make decisions about the change of particular process parameters, in particular the control of actuators for influencing the recorded tool and/or machining parameters and control the actuators accordingly, as shown in FIG. 9 with arrow 90. In this way, maximum automation and autonomy can be achieved.

It is worth noting that for each target value of a target state vector there is a measured value such that deviations to the target value can be analyzed. However, it is not necessary that a target value is associated to each measured value such as, for example, polishing pad temperatures whose development can be monitored and analyzed over the whole process procedure.

Figure 10:
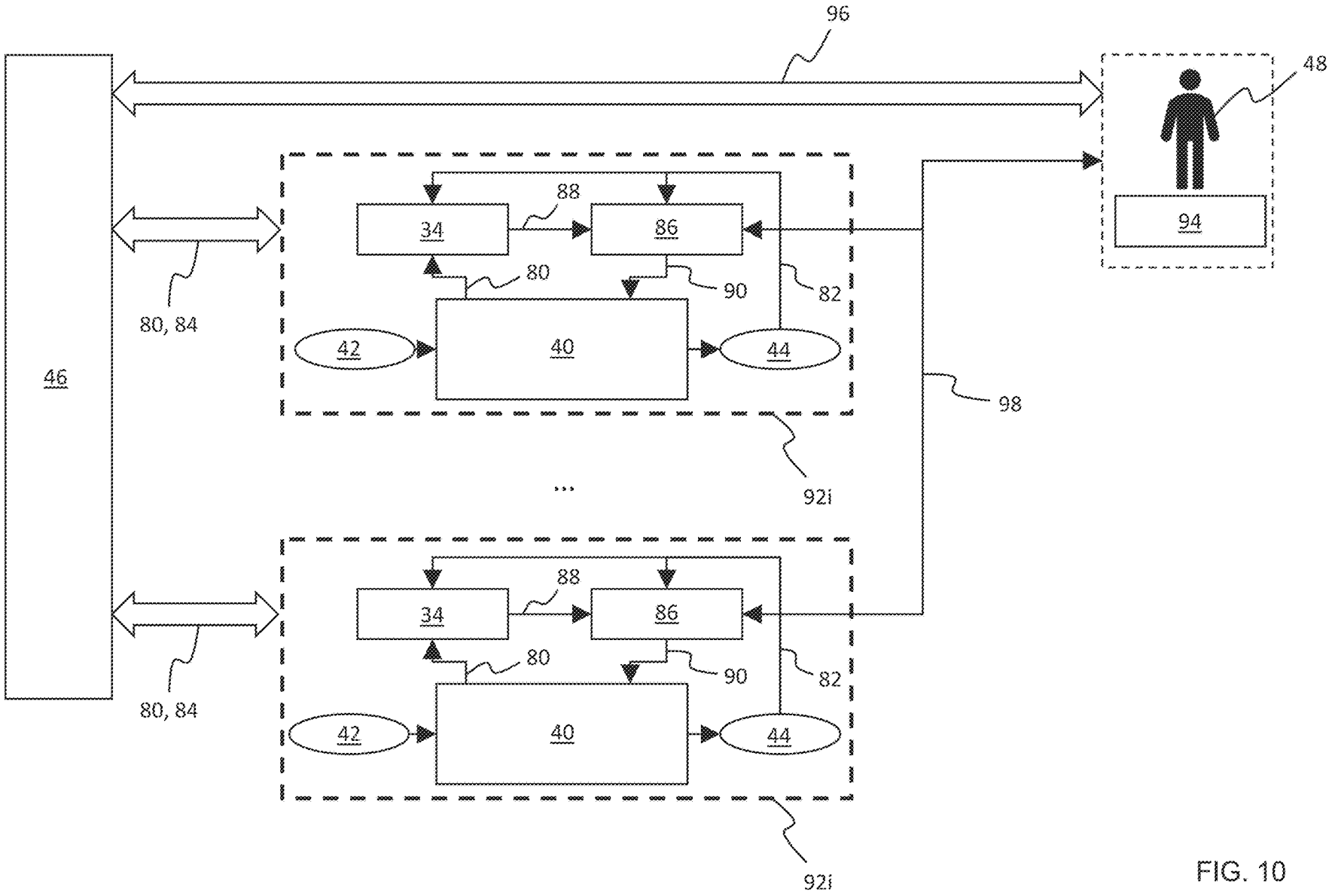
FIG. 10 shows a system in accordance with embodiments of the invention in a schematic representation.

FIG. 10 shows another embodiment of the variant shown in FIG. 9. In particular, FIG. 10 shows a system in accordance with embodiments of the invention comprising at least two double-sided machine tools 40. Of course, the system could also comprise more than two double-sided machine tools 40, illustrated in FIG. 10 by three points. In FIG. 10, two plants **92*i* that may in each case correspond in terms of their design and function to the embodiment according to FIG. 9 are shown as dashed blocks for illustrative purposes. The plants 92*i* may also be designed differently, for example to achieve different aims such as an optimal wafer quality, maximum output, etc. Said plants are connected to a common data memory 46 (shown via arrows 80, 84). Moreover, a higher-level artificial neural network 94, which, for example, also comprises a LCS and which may also be linked to an operator 48, is provided in the system shown in FIG. 10. The higher-level artificial neural network 94 is also connected to the data memory 46, as shown with arrow 96. Moreover, the higher-level artificial neural network 94 obtains the control commands executed in each case by the additional artificial neural network 86, as shown in FIG. 10 with arrow 98. On this basis, the higher-level artificial neural network 94 can further optimize or specialize the additional artificial neural networks 86 of the plants 92*i*, for example by specifying collective or individual control rules and/or target state vectors for the individual plants 92*i***.

THE FOLLOWING IS A LIST OF REFERENCE SIGNS USED IN THIS SPECIFICATION AND IN THE DRAWINGS

10 Upper support disk
12 Lower support disk
14 Upper working disk
16 Lower working disk
18 Working gap
20 First distance-measuring apparatus
22 Second distance-measuring apparatus
24 Third distance-measuring apparatus
26 First fastening location
28 Second fastening location
30 Pressure volume
32 Dynamic pressure line
34 Control apparatus
36 Convex deformation
38 Concave deformation
50 Arrow
52, 54, 56 Arrow
58, 60, 62 Arrow

66, 68, 70 Arrow
72, 74, 78 Arrow
80, 82, 84 Arrow
88, 90, 96 Arrow
98 Arrow
40 Double-sided machine tool
42 Unmachined workpieces
44 Machined workpieces
46 Data memory
48 Operator
64 Regulation apparatus
76, 86 Additional artificial neural network
94 Higher-level artificial neural network
92*i* Plants

What is claimed is:

1. A double-sided or single-sided machine tool, comprising:

a first working disk and a counter-bearing element, wherein the first working disk and the counter-bearing element can be driven rotationally relative to each other by means of a rotary drive, and wherein a working gap is formed between the first working disk and the counter-bearing element for the double-sided or single-sided machining of flat workpieces;

sensors that record measurement data relating to at least one of tool parameters or operating parameters of the double-sided or single-sided machine tool during operation of the double-sided or single-sided machine tool, wherein the sensors comprise measuring apparatuses for measuring at least one of at least one of a thickness or shape of workpieces machined in the double-sided or single-sided machine tool;

a control apparatus that obtains the measurement data recorded by the sensors during operation of the double-sided or single-sided machine tool, wherein the control apparatus comprises an artificial neural network that is designed to create a state vector of the double-sided or single-sided machine tool from the measurement data and to compare the state vector created with a target state vector; and a regulator that is designed, when the state vector created deviates from the target state vector, to control at least one of the tool parameters or the operating parameters of the double-sided or single-sided machine tool, such that the state vector resulting from the control matches the target state vector; and wherein the regulator controls actuators to change the shape and/or a width of the working gap between the first working disk and the counter-bearing element.

2. The double-sided or single-sided machine tool according to claim 1, wherein the control apparatus is designed to issue a warning message when the state vector deviates from the target state vector.

3. The double-sided or single-sided machine tool according to claim 1, wherein the regulator is integrated in the control apparatus.

4. The double-sided or single-sided machine tool according to claim 3, wherein the regulator is designed to control at least one of the tool parameters or the operating parameters of the double-sided or single-sided machine tool based on an adjustment rule stored in the regulator.

5. The double-sided or single-sided machine tool according to claim 4, wherein an additional artificial neural network is provided that is designed to assess the measurement data by means of machine learning and to create or modify an adjustment rule stored in the regulator.

6. The double-sided or single-sided machine tool according to claim 5, wherein the regulator is integrated in the additional artificial neural network.

7. The double-sided or single-sided machine tool according to claim 1, wherein the control apparatus is configured to compare the state vector with multiple target state vectors including the target state vector, and is configured to control, when the state vector deviates from each of the multiple target state vectors, at least one of the tool parameters or the operating parameters of the double-sided or single-sided machine tool, such that the state vector resulting from the control matches one of the multiple target state vectors.

8. The double-sided or single-sided machine tool according to claim 6, wherein the regulator is integrated in the control apparatus.

9. The double-sided or single-sided machine tool according to claim 1, wherein an additional artificial neural network is provided that is designed to assess the measurement data by means of machine learning and to control at least one of the tool parameters or the operating parameters of the double-sided or single-sided machine tool, based on the assessment.

10. The double-sided or single-sided machine tool according to claim 1, wherein an additional artificial neural network is provided that is designed to assess the measurement data by means of machine learning and to create or modify an adjustment rule stored in the regulator.

11. The double-sided or single-sided machine tool according to claim 10, wherein the regulator regulation apparatus is integrated in the additional artificial neural network.

12. The double-sided or single-sided machine tool according to claim 1, wherein the sensors comprise measuring apparatuses for measuring at least one of a distance between the first working disk and the counter-bearing element, a temperature of at least one of the first working disk, the counter-bearing element, or other machine components of the double-sided or single-sided machine tool, at least one of a temperature or a flow rate of a machining agent supplied to the working gap for machining the flat workpieces, a rotational speed of at least one of the first working disk, the counter-bearing element, or rotor disks that are rotatably mounted in the working gap, a load between the first working disk and the counter-bearing element, at least one of a rotational speed, a torque, or a temperature of the rotary drive, at least one of a pressure or a force of a deformation generator of at least one of the first working disk or the counter-bearing element, a thickness of a working lining of at least one of the first working disk or the counter-bearing element.

13. The double-sided or single-sided machine tool according to claim 1, wherein:

the counter-bearing element is formed by a second working disk;

the first working disk and second working disk are arranged coaxially to each other and can be driven rotationally relative to each other; and the working gap is formed between the first working disk and the second working disk for double-sided or single-sided machining of flat workpieces.

14. The double-sided or single-sided machine tool according to claim 1, wherein the artificial neural network is pretrained prior to operation of the double-sided or single-sided machine tool by inputting target state vectors corresponding to acceptable tool and/or machining parameters of the double-sided or single-sided machine tool.

15. The double-sided or single-sided machine tool according to claim 1, wherein the control apparatus is designed to store a plurality of target state vectors and to select, from the plurality of target state vectors, a target state vector corresponding to a current machining operation for comparison with the state vector created from the measurement data.

16. A system, comprising:

at least two double-sided or single-sided machine tools, wherein each double-sided or single-sided machine tool comprises:

a first working disk and a counter-bearing element, wherein the first working disk and the counter-bearing element can be driven rotationally relative to each other by means of a rotary drive, and wherein a working gap is formed between the first working disk and the counter-bearing element for the double-sided or single-sided machining of flat workpieces;

sensors that record measurement data relating to at least one of tool parameters or machining parameters of the double-sided or single-sided machine tool during operation of the double-sided or single-sided machine tool wherein the sensors comprise measuring apparatuses for measuring at least one of at least one of a thickness or shape of workpieces machined in the double-sided or single-sided machine tool; and a control apparatus that obtains the measurement data recorded by the sensors during operation of the double-sided or single-sided machine tool, wherein the control apparatus comprises an artificial neural network that is designed to create a state vector of the double-sided or single-sided machine tool from the measurement data and to compare the state vector with a target state vector;

a regulator, and a higher-level artificial neural network connected to the artificial neural network of each of the at least two double-sided or single-sided machine tools, wherein the higher-level artificial neural network is designed to train at least one artificial neural network of the at least two double-sided or single-sided machine tools based on data obtained by the artificial neural network of each of the at least two double-sided or single-sided machine tools by inputting state vectors that lead to an acceptable machining result of flat workpieces, wherein the regulator controls actuators to change the shape and/or a width of the working gap between the first working disk and the counter-bearing element.

17. A method for operating a double-sided or single-sided machine tool, wherein the double-sided or single-sided machine tool comprises;

a first working disk and a counter-bearing element, the first working disk and the counter-bearing element can be driven rotationally relative to each other by means of a rotary drive, a working gap formed between the first working disk and the counter-bearing element for the double-sided or single-sided machining of flat workpieces;

a regulator, wherein the regulator is designed, when a state vector created deviates from a target state vector, to control at least one of a tool parameter or the operating parameters of the double-sided or single-sided machine tool, such that the state vector resulting from the control matches the target state vector; and sensors that record measurement data relating to at least one of tool parameters or operating parameters of the double-sided or single-sided machine tool during operation of the double-sided or single-sided machine tool, wherein the sensors comprise measuring apparatuses for measuring at least one of at least one of a thickness or shape of workpieces machined in the double-sided or single-sided machine tool, the method comprising:

obtaining, by a control apparatus, the measurement data;

creating, using an artificial neural network, a state vector of the double-sided or single-sided machine tool from the measurement data; and comparing the state vector with at least one target state vector;

controlling, with the regulator, actuators to change the shape and/or a width of the working gap between the first working disk and the counter-bearing element.

18. The method according to claim 17, wherein the artificial neural network is trained by inputting target state vectors that lead to an acceptable machining result of flat workpieces.

19. The method according to claim 18, wherein the artificial neural network is trained further during operation of the double-sided or single-sided machine tool by inputting additional target state vectors that lead to an acceptable machining result of flat workpieces.

20. The method according to claim 18, wherein an additional artificial neural network is trained using the artificial neural network by inputting target state vectors that lead to an acceptable machining result of flat workpieces during operation of the double-sided or single-sided machine tool.

* * * * *